US011700492B2

(12) United States Patent
Ding

(10) Patent No.: US 11,700,492 B2
(45) Date of Patent: Jul. 11, 2023

(54) GUARD RING IN CAVITY PCB

(71) Applicant: Knowles Electronics, LLC, Itasca, IL (US)

(72) Inventor: Fei Ding, Buffalo Grove, IL (US)

(73) Assignee: Knowles Electronics, LLC, Itasca, IL (US)

( * ) Notice: Subject to any disclaimer, the term of this patent is extended or adjusted under 35 U.S.C. 154(b) by 246 days.

(21) Appl. No.: 17/109,258

(22) Filed: Dec. 2, 2020

(65) Prior Publication Data

US 2021/0176568 A1 Jun. 10, 2021

Related U.S. Application Data

(60) Provisional application No. 62/946,368, filed on Dec. 10, 2019.

(51) Int. Cl.
*H04R 19/04* (2006.01)
*H04R 1/08* (2006.01)
*H04R 1/04* (2006.01)

(52) U.S. Cl.
CPC ..... *H04R 19/04* (2013.01); *H04R 1/04* (2013.01); *H04R 1/086* (2013.01); *H04R 2201/003* (2013.01)

(58) Field of Classification Search
CPC ..... H04R 19/04; H04R 1/04; H04R 1/086; H04R 2201/003; H04R 31/00; H04R 2499/11
See application file for complete search history.

(56) References Cited

U.S. PATENT DOCUMENTS

2007/0082421 A1* 4/2007 Minervini ..... H04R 31/006 438/51
2007/0222008 A1* 9/2007 Chen ..... B81C 1/00896 257/415
2009/0092274 A1* 4/2009 Song ..... H04R 31/006 381/361
2011/0158453 A1* 6/2011 Tanaka ..... H04R 19/04 381/361
2011/0222717 A1* 9/2011 Kuratani ..... H04R 19/04 257/416
2013/0119489 A1* 5/2013 Chang ..... B81C 1/00293 257/E31.117
2014/0029078 A1* 1/2014 Fennell ..... G02B 26/001 361/679.01
2016/0014530 A1* 1/2016 Gao ..... H04R 19/005 438/51

(Continued)

*Primary Examiner* — Oyesola C Ojo
(74) *Attorney, Agent, or Firm* — Loppnow & Chapa; Matthew C. Loppnow

(57) ABSTRACT

A microphone assembly including an acoustic transducer configured to generate an electrical signal responsive to acoustic activity, an integrated circuit electrically coupled to the acoustic transducer and configured to receive the electrical signal from the acoustic transducer and generate an output signal representative of the acoustic activity, a cover, and a substrate. The substrate including a first surface and a second surface to which the cover is coupled. The second surface is disposed at a perimeter of the substrate and the first surface is raised with respect to the second surface. The cover is coupled to the substrate to form a housing in which the transducer and the integrated circuit are disposed.

20 Claims, 6 Drawing Sheets

(56) References Cited

U.S. PATENT DOCUMENTS

| | | | | |
|---|---|---|---|---|
| 2018/0127269 | A1* | 5/2018 | Long | B81C 1/00301 |
| 2018/0343524 | A1* | 11/2018 | Lim | H04R 1/04 |
| 2019/0145806 | A1* | 5/2019 | Lim | B81B 7/008 73/861.27 |

* cited by examiner

GUARD RING IN CAVITY PCB

CROSS-REFERENCE TO RELATED APPLICATIONS

The present application claims the priority benefit of U.S. Provisional patent Application No. 62/946,368, filed Dec. 10, 2019 and incorporated herein by reference.

BACKGROUND

The present disclosure relates generally to the field of microphone assemblies and substrates for such assemblies.

Microphone assemblies are utilized in a variety of applications, such as, mobile phones, and recording devices, to record acoustic signals. Microphone assemblies can include a can soldered to a substrate to protect components and improve functions of the microphone assemblies. Solder contacting the components can cause malfunctioning and/or failure of the microphone assembly during operation.

BRIEF DESCRIPTION OF THE DRAWINGS

The foregoing and other features of the present disclosure will become more fully apparent from the following description and appended claims, taken in conjunction with the accompanying drawings. These drawings depict only several embodiments in accordance with the disclosure and are, therefore, not to be considered limiting of its scope. Various embodiments are described in more detail below in connection with the appended drawings.

DETAILED DESCRIPTION

Figure 1:
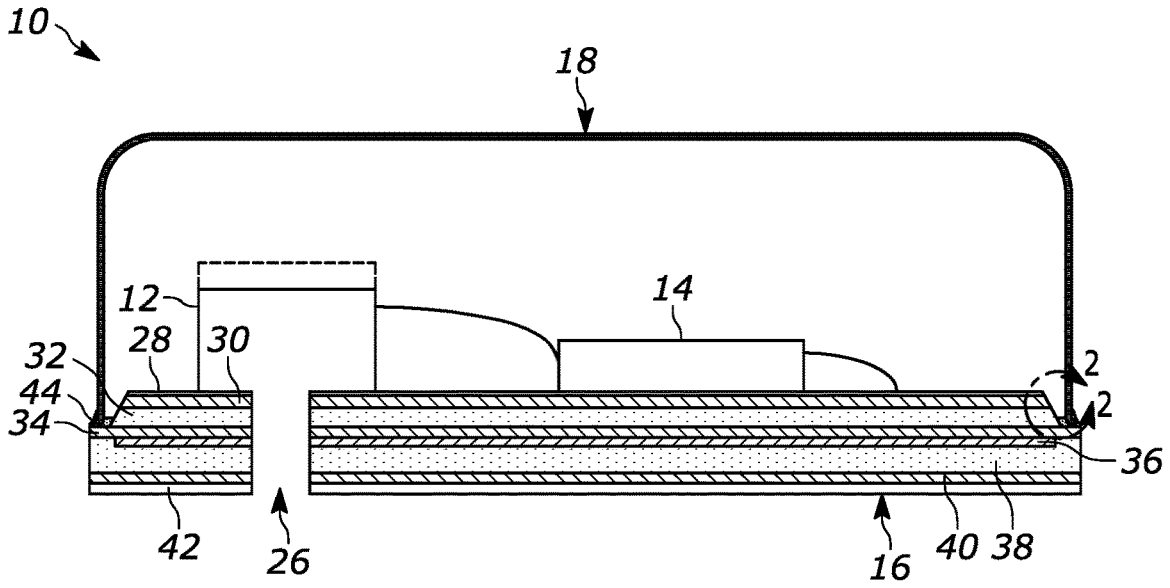
FIG. 1 is a partial-section view of a microphone assembly.

The embodiments disclosed herein are structured to limit flow of solder onto components mounted on the substrate during manufacturing. In particular, the microphone assemblies disclosed herein have a trench on a surface of the substrate which is formed during manufacturing of the microphone assemblies. The trench is shaped to have the can mounted thereon and limit contact of the solder with the components on the substrate. The trench may be formed around a perimeter of the substrate and a portion of the can extends below a surface of the substrate and is mounted to a surface of the trench.

During production, a plurality of microphone assemblies may be formed as an array. The trench of each of the microphone assemblies of the array may be manufactured during a single manufacturing step. The trench is at least partially filled with a bonding material, such as solder, to couple the can to the substrate.

Among other benefits, the surface of the substrate being raised relative to a surface of the trench restricts the solder from flowing onto the components on the substrate. The overall size of the microphone assembly can also be reduced, as the can extends partially below the surface of the substrate. The can may also form a barrier to reduce signal leaking from the substrate. The details of the general depiction provided above will be more fully explained by reference to FIGS. 1-5B.

Referring generally to the figures a microphone assembly 10 is shown. Microphone assembly 10 is configured to sense acoustic activity (e.g., sound waves, etc.) and generate an electrical signal in response to the acoustic activity. Microphone assembly 10 is configured to be installed within a device (e.g., a mobile phone, a camera, a recorder, etc.). Microphone assembly 10 includes an acoustic transducer 12. Acoustic transducer 12 is configured to generate an electrical signal responsive to acoustic activity. In some embodiments, acoustic transducer 12 is a microelectromechanical systems (MEMS) transducer. Microphone assembly 10 also includes an integrated circuit 14. Integrated circuit 14 is configured to receive the electrical signal from acoustic transducer 12 and generate an output signal representative of the acoustic activity. In some embodiments, integrated circuit 14 is an application specific integrated circuit (ASIC). Microphone assembly 10 also includes a substrate, shown as substrate 16. In some embodiments, substrate 16 is a printed circuit board. In some embodiments, acoustic transducer 12 and integrated circuit 14 are coupled to substrate 16. Microphone assembly 10 also includes a cover 18. In some embodiments, acoustic transducer 12 is coupled to cover 18. In some embodiments, cover 18 is a can, such as a metal can. Cover 18 is structured to define an internal cavity between cover 18 and substrate 16. Cover 18 includes a foot, shown as foot 48. Foot 48 protrudes from cover 18 at an angle.

Referring to FIG. 1 a cross-section view of microphone assembly 10 is shown. Microphone assembly 10 includes acoustic transducer 12, integrated circuit 14, cover 18, and substrate 16. Substrate 16 is formed from at least one layer, which includes a first layer 28. First layer 28 is configured to form a mounting surface for acoustic transducer 12 and integrated circuit 14. In some embodiments, first layer 28 is a non-conductive material (e.g., solder mask, solder resist, solder oil, etc.). Substrate 16 also includes conductive layers 30, 34, 36, and 40, and nonconductive layers 32, and 38. In other embodiments, different numbers of layers or different layers may be utilized. Substrate 16 includes a second layer 42 opposite first layer 28. Second layer 42 defines an outer surface of microphone assembly 10. In some embodiments, second layer 42 is a non-conductive material (e.g., solder mask, solder resist, solder oil, etc.). In some embodiments, substrate 16 defines port 26 formed through the layers of substrate 16. In other embodiments, cover 18 defines a port (e.g., similar to port 26 and performing the same function), extending through cover 18. Port 26 is structured to provide a pathway for acoustic signals to pass through substrate 16, or cover 18 and into contact with acoustic transducer 12.

Substrate 16 also defines a trench 46 around a perimeter of substrate 16. Trench 46 is formed by conductive layer 30 and nonconductive layers 32 being smaller (e.g., smaller diameter) than conductive layers 34, 36, and 40 and nonconductive layer 38. In other embodiments, trench 46 is defined by different layers of substrate 16. Conductive layer 34 defines a surface to which cover 18 couples (e.g., with a bonding material 44).

Figure 2:
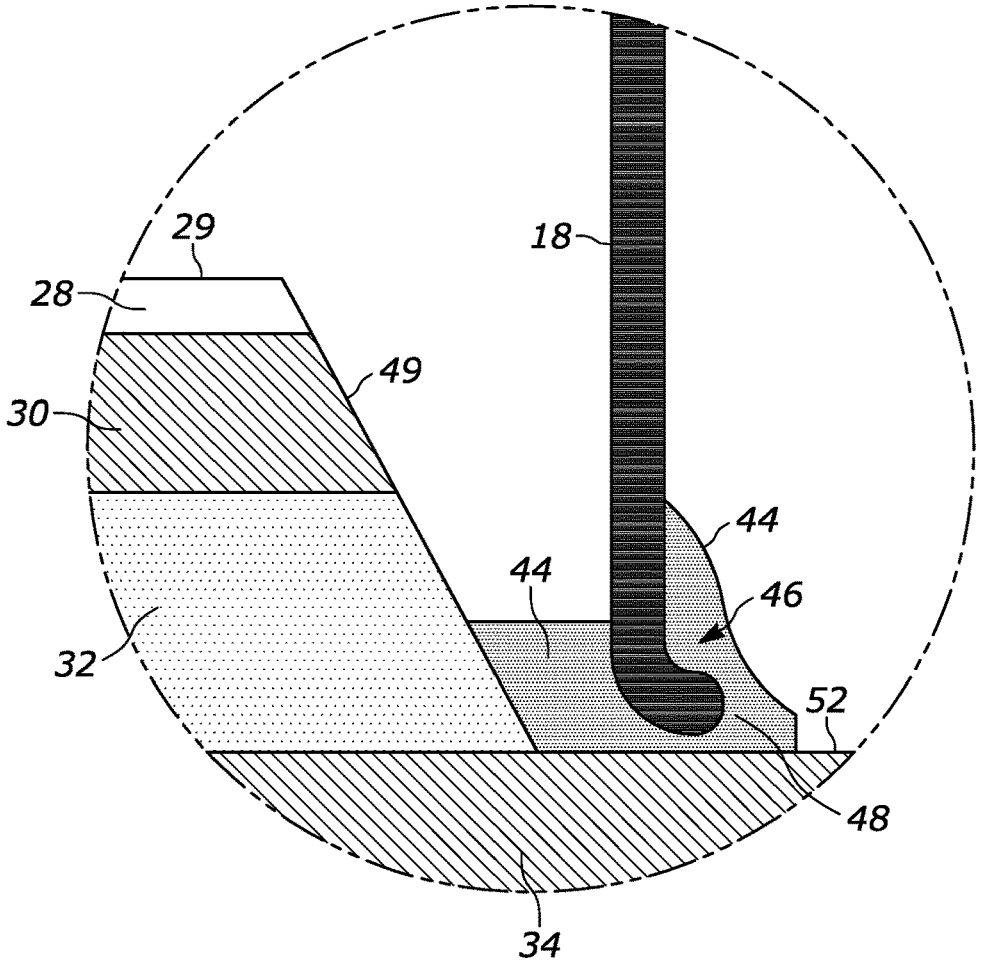
FIG. 2 is a partial-section view of the microphone assembly of FIG. 1.

Referring to FIG. 2, trench 46 is shown with greater detail. Foot 48 of cover 18 is between first layer 28 and conductive layer 34, when cover 18 is coupled to trench 46. First layer 28 defines a first surface 29, to which acoustic transducer 12 and integrated circuit 14 are coupled. Conductive layer 34 defines a second surface 52, to which at least one of foot 48 and bonding material 44 are coupled. First layer 29 is raised relative to second surface 52, facilitating first layer 28, conductive layer 30, and nonconductive layer 32 being disposed within a perimeter of cover 18. In some embodiments, foot 48 being between first layer 28 and conductive layer 34 facilitates formation of a barrier, within cover 18, for limiting acoustic signals from leaving substrate 16. Side walls of first layer 28, conductive layer 30, and nonconductive layer 32, define side wall 49 of trench 46. Side wall 49 helps cover 18 couple to substrate 49 by defining another surface to which bonding material 44 can adhere.

Figure 3A:
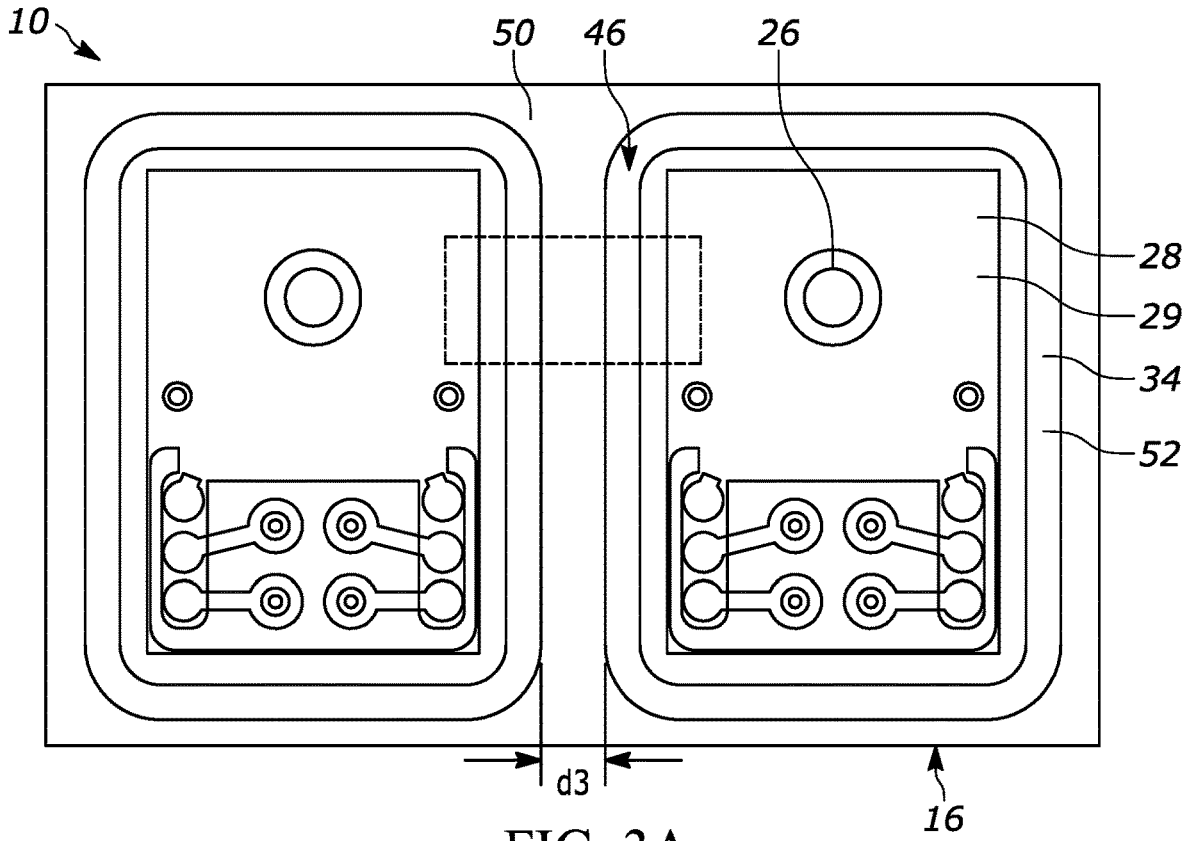
FIG. 3A is a perspective view of an array of microphone assemblies.

FIG. 3A is a partial view of an array 10 of microphone assembly substrates 16. A spacing layer 50 separates each microphone assembly substrate from each other a distance d3 (e.g., 174±5 μm, etc.). Spacing layer 50 is a portion of nonconductive layer 32. In some embodiments, spacing layer 50 is formed separately of nonconductive layer 32. Spacing layer 50 also defines a side wall of trench 46.

Figure 4A:
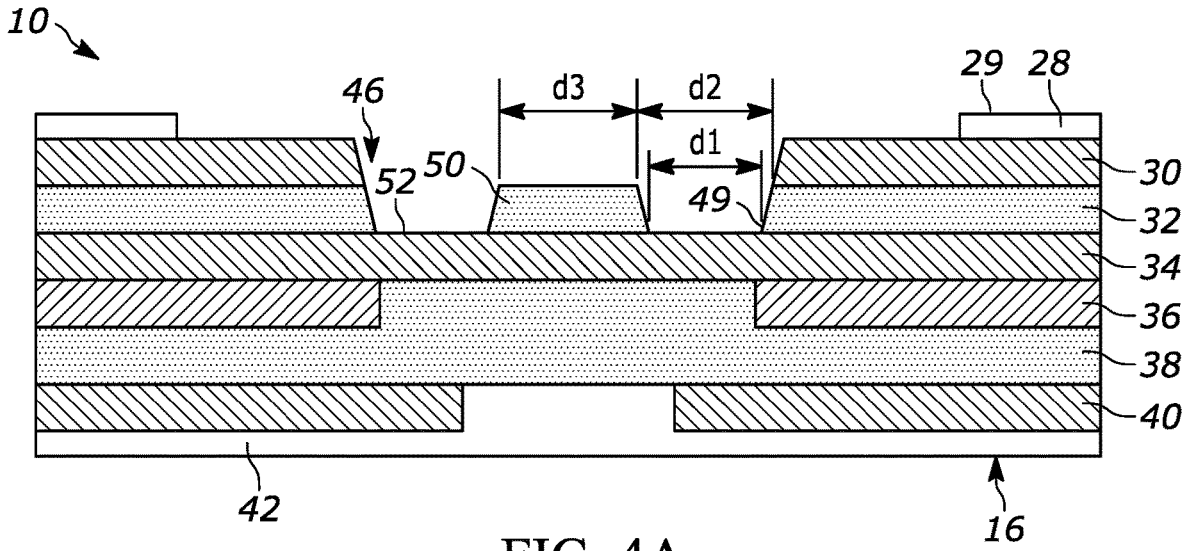
FIG. 4A is a partial-section view of the array of microphone assemblies of FIG. 3A.

FIG. 4A is a section view of the array 10 of microphone assembly substrates 16. During manufacturing of substrate 16, conductive layers 30, 34, 36, and 40, nonconductive layers 32 and 38, first layer 28, and second layer 42 are coupled to form substrate 16. Trench 46 is around a perimeter of each substrate 16. Trench 46 is defined by side wall 49 and spacing layer 50 on sides, and second surface 52 of conductive layer 34 on a bottom. In some embodiments, trench 46 is formed by removal of a portion of substrate 16 (e.g., laser, etc.). In other embodiments, trench 46 is formed during coupling of layers of substrate 16, without removal of material. Trench 46 is formed to have a lower distance, d1, of 203-207 μm, and an upper distance, d2, of 227-235 μm. In some embodiments, d1 and d2 are equal.

Figure 3B:
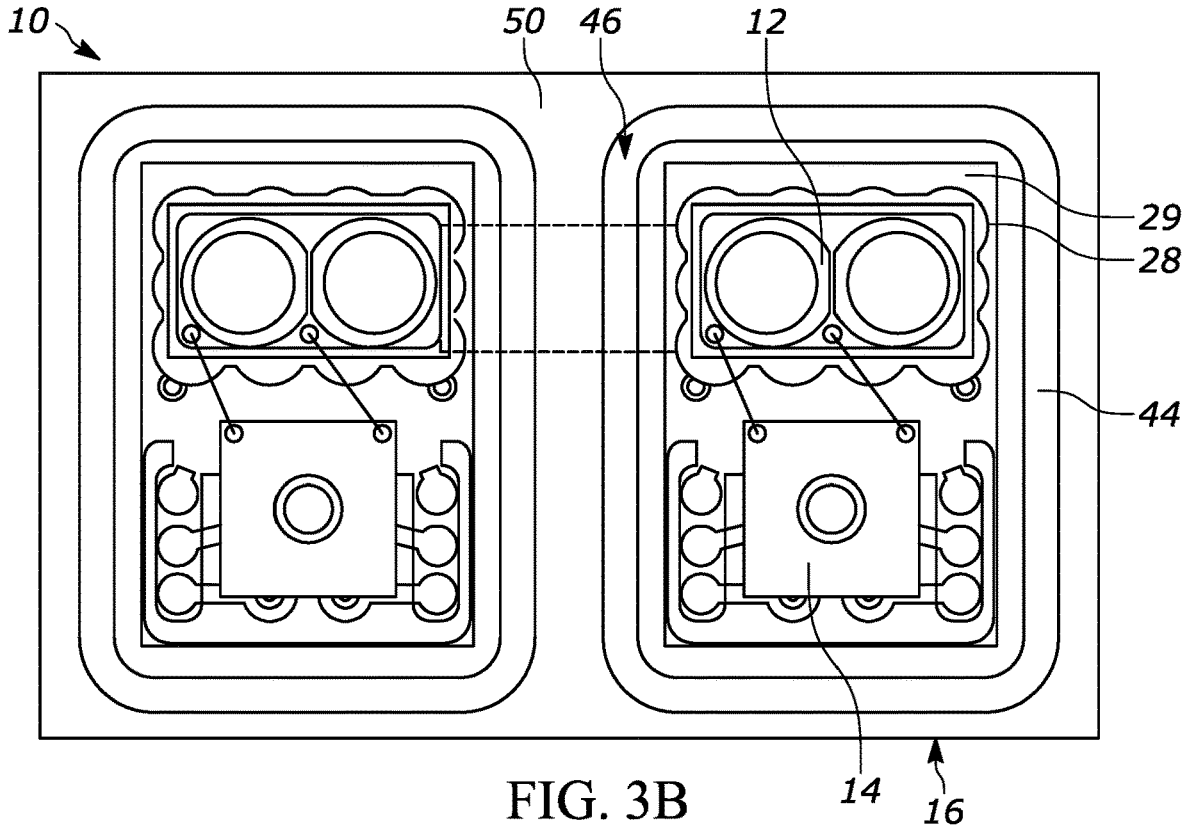
FIG. 3B is a perspective view of an array of microphone assemblies.

FIG. 3B is the array 10 of microphone assembly substrates 16 during formation of trench 46. Acoustic transducer 12 and integrated circuit 14 are coupled to each substrate 16. Trench 46 of each microphone assembly 10 is at least partially filled with bonding material 44.

Figure 4B:
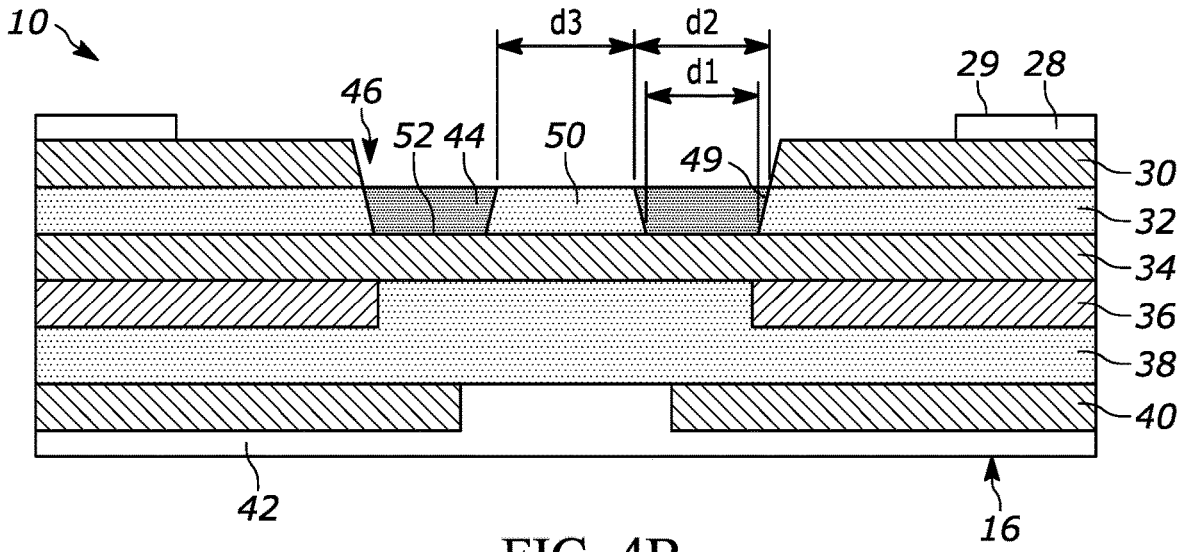
FIG. 4B is a partial-section view of the array of microphone assemblies of FIG. 3B.

FIG. 4B is a section view of the array 10 of microphone assembly substrates 16 during formation of trench 46. Trench 46 is at least partially filled with bonding material 44. Bonding material 44 is held within trench 46 by spacing wall 50 and side wall 49. First surface 29 being raised relative to second surface 52 limits bonding material 44 from leaving trench 46.

Figure 3C:
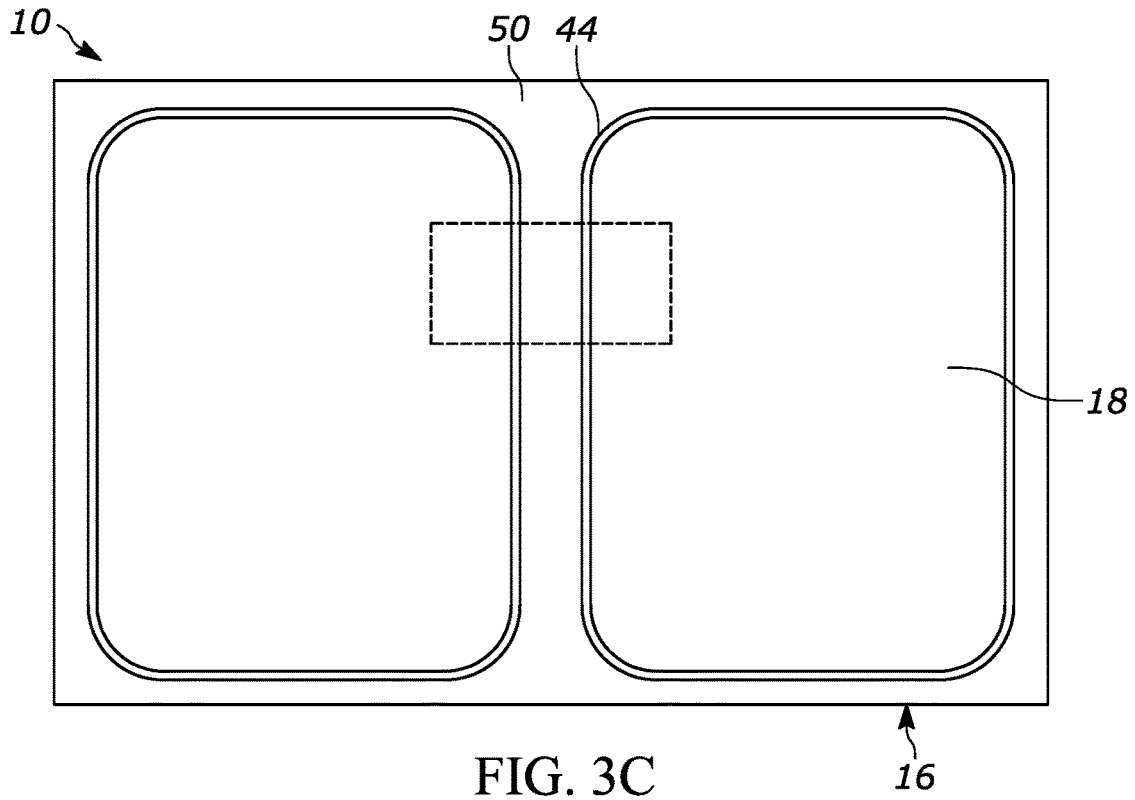
FIG. 3C is a perspective view of an array of microphone assemblies.

FIG. 3C is an array of microphone assemblies 10 during coupling of cover 18 to substrate 16. Each substrate 16 accepts a cover 18, which limits access to acoustic transducer 12 and integrated circuit 14.

Figure 4C:
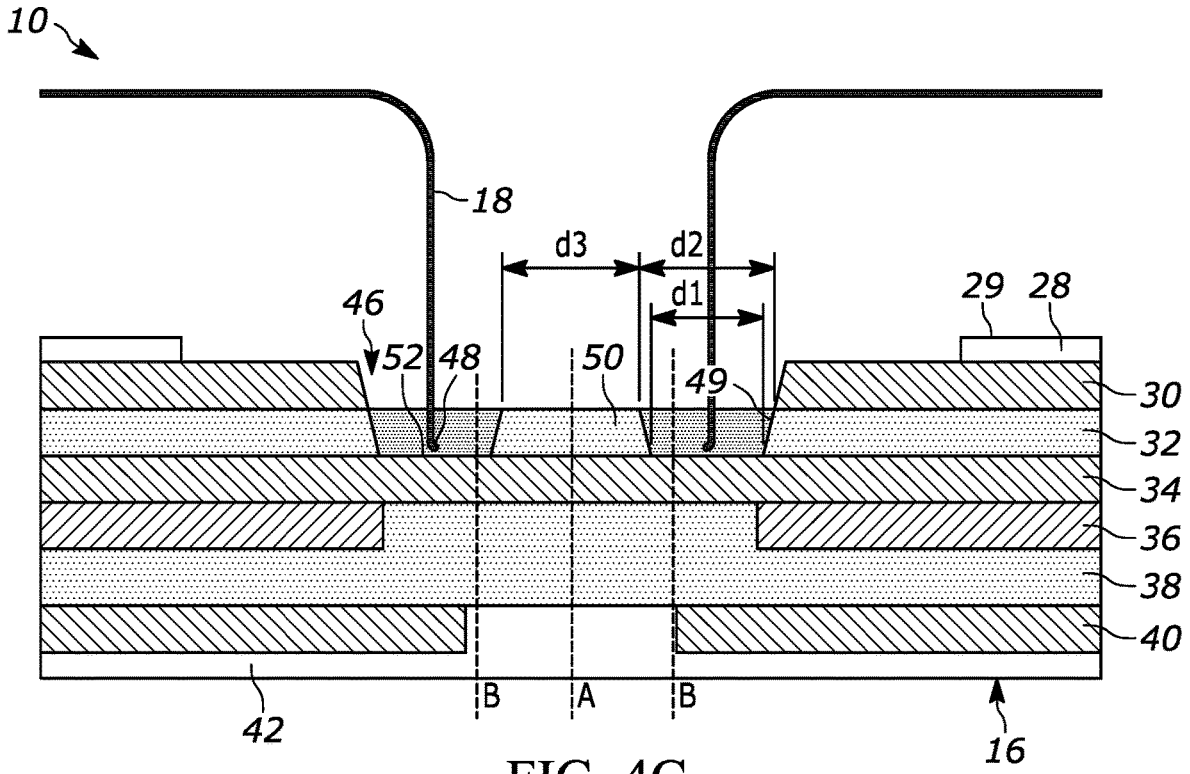
FIG. 4C is a partial-section view of the array of microphone assemblies of FIG. 3C.

FIG. 4C is a section view of the array of microphone assemblies 10 during coupling of cover 18 to substrate 16. Trench 46 accepts foot 48 of cover 18 and bonding material 44 couples cover 18 to substrate 16. Foot 48 is lowered relative to first layer 28 when cover 18 is coupled to substrate 16. In some embodiments, foot 48 contacts second surface 52. In other embodiments, foot 48 is raised relative to second surface 52 and bonding material interfaces between second surface 52 and foot 48. Each individual microphone assembly 10 of the array of microphone assemblies 10 is diced from each other to form microphone assembly 10. In some embodiments, dicing occurs at a dicing line, shown as dicing line A. In other embodiments, dicing occurs at another dicing line, shown as dicing line B.

Figure 5A:
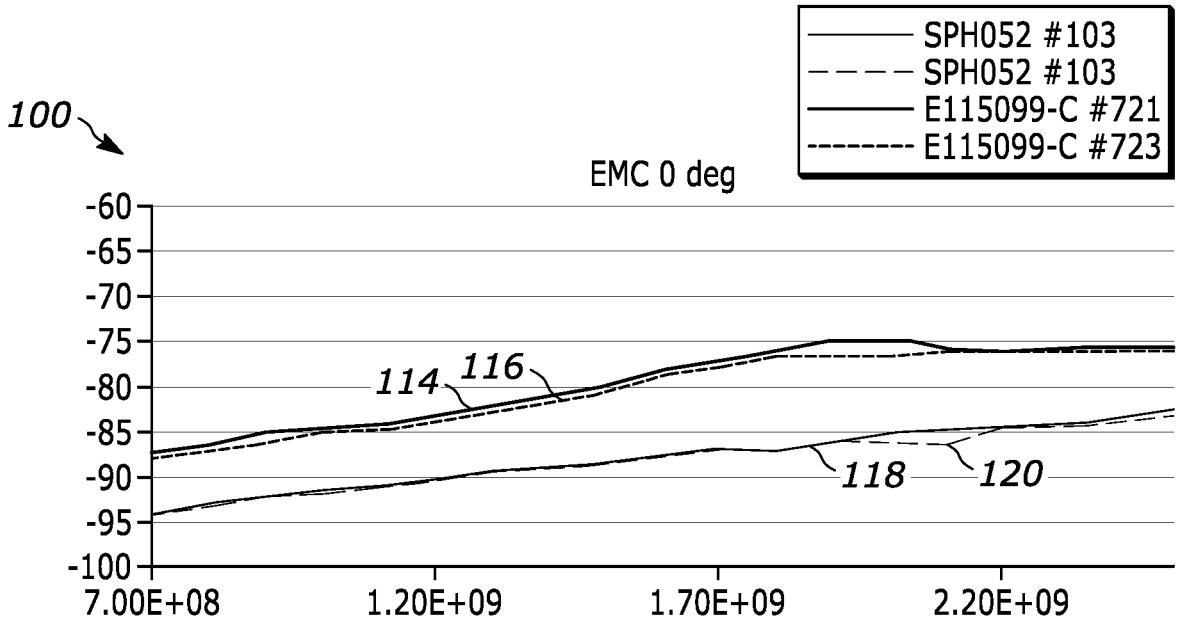
FIG. 5A is a graph of electromagnetic compatibility at 0 degrees.
Figure 5B:
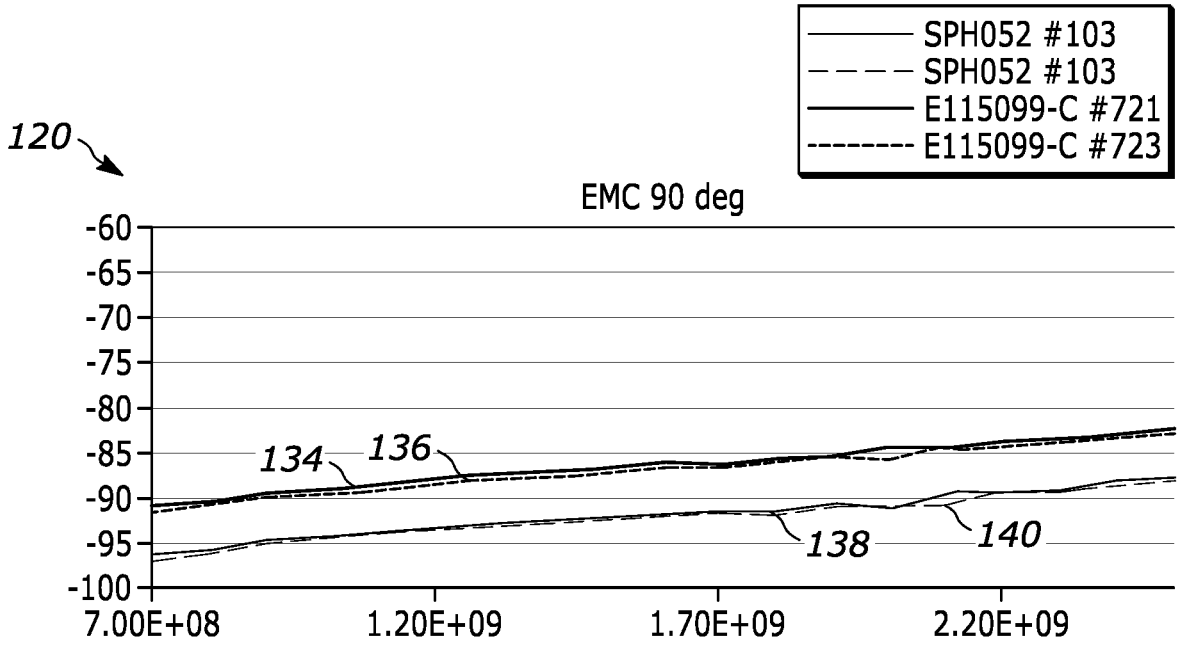
FIG. 5B is a graph of electromagnetic compatibility at 90 degrees.

FIGS. 5A and 5B are a graph of test results of microphone assembly 10. Acoustic signals are directed toward a microphone assembly at an angle. The microphone assembly being tested has a response in decibels representing a resistance of the microphone assembly to unintentional acceptance of acoustic signals. A first table, shown as table 100, represents an Electro Magnetic Compatibility (e.g., EMC, etc.) test at 0 degrees. Lines 114 and 116 each represent a response of an existing microphone assembly to the acoustic signals. Lines 118 and 120 each represent a response of microphone assembly 10 to the acoustic signals. Another table, shown as table 120, represents an Electro Magnetic Compatibility (e.g., EMC, etc.) test at 90 degrees. Lines 134 and 136 represent a response of an existing microphone assembly to the acoustic signals. Lines 138 and 140 represent a response of microphone assembly 10 to the acoustic signals. Microphone assembly 10, as shown by lines 118 and 120 in table 100 and lines 138 and 140 in table 120, has better resistance to external RF signals than prior microphone assemblies.

A first aspect of the present disclosure relates to a microphone assembly. The microphone assembly including an acoustic transducer configured to generate an electrical signal responsive to acoustic activity, an integrated circuit electrically coupled to the acoustic transducer and configured to receive the electrical signal from the acoustic transducer and generate an output signal representative of the acoustic activity, a cover, and a substrate. The substrate including a first surface and a second surface to which the cover is coupled, wherein the second surface is disposed at a perimeter of the substrate and the first surface is raised with respect to the second surface wherein the cover is coupled to the substrate to form a housing in which the transducer and integrated circuit are disposed.

Figure 6:
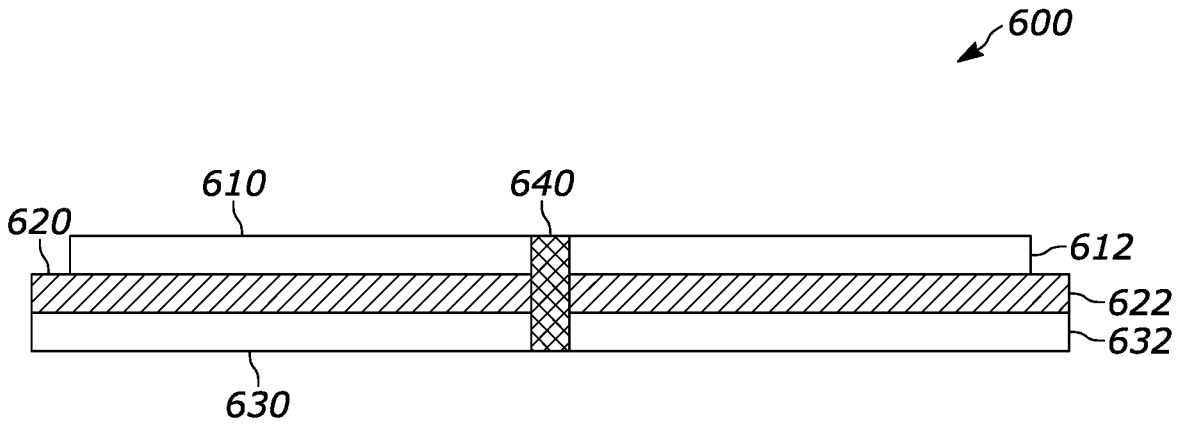
FIG. 6 is a partial-section view of a microphone assembly substrate.

FIG. 6 is a partial-section view of a microphone assembly substrate 600, such as the substrate 16 of FIG. 1. The substrate 600 includes a first surface 610 defined by a first layer 612. The substrate 600 includes a second surface 620 defined by a second layer 622 and disposed around a perimeter of the microphone assembly substrate 600. The first surface 610 is raised relative to the second surface 620. The substrate 600 includes a third surface 630 defined by a third layer 632. The substrate 600 includes a conductive trace 640 on the first surface 610 and extending to the third surface 630, the conductive trace facilitating electrical signal transmission from a component mounted on the first surface to a device external the microphone assembly substrate 600. The illustrated substrate 600 is only a graphical representation of what is described in the present paragraph and does not otherwise imply any particular scale, orientation, or location of any of the illustrated elements beyond the written description in this paragraph.

A second aspect of the present disclosure relates to a microphone assembly substrate. The substrate including a first surface defined by a first layer, and a second surface defined by a second layer. The first surface is raised relative to the second surface. The substrate also including a third surface defined by a third layer, and a conductive trace on the first surface and extending to the third surface, the conductive trace facilitating electrical signal transmission from a component mounted on the first surface to a device external the microphone assembly.

The herein described subject matter sometimes illustrates different components contained within, or connected with, different other components. It is to be understood that such depicted architectures are illustrative, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It will be further understood by those within the art that if a specific number of an introduced claim recitation is intended, such an intent will be explicitly recited in the claim, and in the absence of such recitation, no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general, such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

Further, unless otherwise noted, the use of the words "approximate," "about," "around," "substantially," etc., mean plus or minus ten percent.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. A microphone assembly comprising:

an acoustic transducer configured to generate an electrical signal responsive to acoustic activity;

an integrated circuit electrically coupled to the acoustic transducer and configured to receive the electrical signal from the acoustic transducer and generate an output signal representative of the acoustic activity;

a cover; and a substrate comprising a first surface and a second surface to which the cover is coupled, wherein the second surface is disposed at a perimeter of the substrate and the first surface is raised with respect to the second surface, wherein the cover is coupled to the substrate to form a housing in which the acoustic transducer and the integrated circuit are disposed, wherein the first surface extends across a planar layer and the acoustic transducer and the integrated circuit are both mounted on the first surface.

2. The microphone assembly of claim 1, wherein a foot of the cover is disposed at the perimeter of the substrate below the first surface and coupled to the second surface of the substrate.

3. The microphone assembly of claim 2, wherein the foot of the cover is positioned between the first surface and the second surface of the substrate.

4. The microphone assembly of claim 1, wherein the substrate comprises a plurality of conductive layers and at least one non-conductive layer, the substrate having a surface-mountable external-device interface with contacts electrically coupled to the integrated circuit.

5. The microphone assembly of claim 4, wherein the first surface is a surface of a first non-conductive layer of the at least one non-conductive layers and the second surface is a surface of a first conductive layer of the plurality of conductive layers.

6. The microphone assembly of claim 1, further comprising a bonding material disposed on the second surface and in contact with a portion of the cover.

7. The microphone assembly of claim 6, wherein the bonding material is in contact with a wall portion between the first surface and the second surface.

8. The microphone assembly of claim 7, wherein a foot of the cover is coupled to at least one of the second surface or the wall portion by the bonding material.

9. The microphone assembly of claim 6, wherein the first surface is devoid of the bonding material.

10. The microphone assembly of claim 1, the housing comprises a sound port, wherein an interior of the housing is acoustically coupled to an exterior of the housing via the sound port.

11. The microphone assembly of claim 1, further comprising a conductive trace on the first surface and extending to a third surface of the substrate and configured to facilitate electrical signal transmission between a component mounted on an external of the microphone assembly and the microphone assembly.

12. A microphone assembly substrate comprising:

a first surface defined by a first layer;

a second surface defined by a second layer and disposed around a perimeter of the microphone assembly substrate, wherein the first surface is raised relative to the second surface;

a third surface defined by a third layer; and a conductive trace on the first surface and extending to the third surface, the conductive trace facilitating electrical signal transmission from a component mounted on the first surface to a device external the microphone assembly substrate, wherein an acoustic transducer and an integrated circuit are both mounted on the first surface.

13. The microphone assembly substrate of claim 12, wherein the conductive trace is disposed within the perimeter of the microphone assembly substrate.

14. The microphone assembly substrate of claim 12, wherein the microphone assembly substrate comprises a plurality of conductive layers and at least one non-conductive layer.

15. The microphone assembly substrate of claim 14, wherein the first layer is a first non-conductive layer of the at least one non-conductive layers and the second layer is a first conductive layer of the plurality of conductive layers.

16. The microphone assembly substrate of claim 12, wherein an acoustic port is defined between the first surface and the third surface to allow passage of ingress of acoustic signals through the acoustic port.

17. The microphone assembly substrate of claim 12, further comprising an array of substrates, wherein each of the array of substrates includes the structure of the microphone assembly substrate.

18. The microphone assembly substrate of claim 12, wherein the second surface is formed by removing at least a portion of the microphone assembly substrate.

19. The microphone assembly of claim 12, wherein the first surface is raised relative to the second surface by at least two layers including the first layer, where the at least two layers include a conductive layer and a non-conductive layer.

20. The microphone assembly of claim 12, further wherein a cover is coupled to the second surface to form a housing in which the acoustic transducer and the integrated circuit are disposed.

* * * * *